US008978889B2

(12) United States Patent
Fitzwater et al.

(10) Patent No.: US 8,978,889 B2
(45) Date of Patent: Mar. 17, 2015

(54) CARTON WITH ARTICLE PROTECTION FEATURE

(71) Applicant: Graphic Packaging International, Inc., Atlanta, GA (US)

(72) Inventors: Kelly R. Fitzwater, Lakewood, CO (US); Steven M. Oliveira, Canton, GA (US); Raymond R. Spivey, Sr., Mableton, GA (US); Ana Gonzalez, Igualada (ES)

(73) Assignee: Graphic Packing International, Inc., Atlanta, GA (US)

( * ) Notice: Subject to any disclaimer, the term of this patent is extended or adjusted under 35 U.S.C. 154(b) by 0 days.

(21) Appl. No.: 13/799,569

(22) Filed: Mar. 13, 2013

(65) Prior Publication Data

US 2014/0021080 A1 Jan. 23, 2014

Related U.S. Application Data

(60) Provisional application No. 61/741,315, filed on Jul. 17, 2012.

(51) Int. Cl.
*B65D 5/42* (2006.01)
*B65D 71/40* (2006.01)
(Continued)

(52) U.S. Cl.
CPC ..... *B65D 71/403* (2013.01); *B65B 5/024* (2013.01); *B65B 5/10* (2013.01); *B65D 5/42* (2013.01); *B65D 5/4608* (2013.01); *B65D 5/5026* (2013.01); *B65D 85/20* (2013.01); *B65D 71/36* (2013.01); *B65D 2571/00141* (2013.01);
(Continued)

(58) Field of Classification Search
CPC ..... B65D 71/36; B65D 71/30; B65D 71/12; B65D 71/125; B65D 71/0051; B65D 2571/00277; B65D 2571/00246; B65D 2571/0283; B65D 71/00
USPC ..... 206/427, 434, 429, 433, 142, 158, 148; 229/117.13
See application file for complete search history.

(56) References Cited

U.S. PATENT DOCUMENTS 2,877,894 A 3/1959 Forrer
3,152,688 A * 10/1964 Mahon ..... 206/158
(Continued)

FOREIGN PATENT DOCUMENTS

EP 0 024 782 A1 3/1981
EP 332 153 B1 9/1991
(Continued)

OTHER PUBLICATIONS

International Search Report and Written Opinion for PCT/US2013/030776 dated Jun. 27, 2013.

*Primary Examiner* — Steven A. Reynolds
(74) *Attorney, Agent, or Firm* — Womble Carlyle Sandridge & Rice, LLP

(57) ABSTRACT

A carton for containing at least one article. The carton includes a plurality of panels that extends at least partially around the interior of the carton. The plurality of panels comprises a top panel, a bottom panel, a first side panel, and a second side panel. At least one article retention panel is for retaining the at least one article. The article retention panel is foldably connected to the at least one panel. The article retention panel is positioned relative to the at least one panel to contact the at least one article.

51 Claims, 10 Drawing Sheets

(51) Int. Cl.

| | |
|---|---|
| ***B65B 5/02*** | (2006.01) |
| ***B65B 5/10*** | (2006.01) |
| ***B65D 5/468*** | (2006.01) |
| ***B65D 5/50*** | (2006.01) |
| ***B65D 85/20*** | (2006.01) |
| ***B65D 71/36*** | (2006.01) |

(52) U.S. Cl.

CPC ..... *B65D2571/00265* (2013.01); *B65D 2571/0032* (2013.01); *B65D 2571/0045* (2013.01); *B65D 2571/00574* (2013.01); *B65D 2571/0066* (2013.01); *B65D 2571/00728* (2013.01)

USPC ..... 206/427

(56) References Cited

U.S. PATENT DOCUMENTS

| | | | | | |
|---|---|---|---|---|---|
| 3,167,214 | A | * | 1/1965 | Mahon | 206/155 |
| 3,176,902 | A | * | 4/1965 | Champlin | 206/140 |
| 3,252,649 | A | | 5/1966 | Graser et al. | |
| 3,255,919 | A | | 6/1966 | Koolnis | |
| 3,355,012 | A | | 11/1967 | Weiss | |
| 3,367,557 | A | | 2/1968 | Farquhar | |
| 3,386,570 | A | | 6/1968 | Lock | |
| 3,432,029 | A | | 3/1969 | Brown | |
| 3,669,342 | A | | 6/1972 | Funkhouser | |
| 3,670,950 | A | * | 6/1972 | Rossi | 206/153 |
| 3,679,121 | A | | 7/1972 | Morgese | |
| 3,687,282 | A | | 8/1972 | Owen | |
| 3,715,029 | A | | 2/1973 | Wood | |
| 3,747,801 | A | | 7/1973 | Graser | |
| 3,767,042 | A | | 10/1973 | Ganz | |
| 3,797,729 | A | | 3/1974 | Holmes | |
| 3,921,895 | A | | 11/1975 | Ziche | |
| 3,942,631 | A | | 3/1976 | Sutherland et al. | |
| 3,963,121 | A | | 6/1976 | Kipp | |
| 3,977,518 | A | | 8/1976 | Arneson | |
| 4,034,852 | A | | 7/1977 | Forrer | |
| 4,056,223 | A | | 11/1977 | Williams | |
| 4,093,068 | A | | 6/1978 | Smrt | |
| 4,101,069 | A | | 7/1978 | Wood | |
| 4,131,230 | A | | 12/1978 | Koehlinger et al. | |
| 4,146,168 | A | | 3/1979 | Hartline | |
| 4,186,867 | A | | 2/1980 | Wood | |
| 4,202,446 | A | | 5/1980 | Sutherland | |
| 4,256,226 | A | | 3/1981 | Stone | |
| 4,295,562 | A | | 10/1981 | Wood | |
| 4,324,328 | A | | 4/1982 | Champlin | |
| 4,328,891 | A | | 5/1982 | Elward | |
| 4,330,079 | A | | 5/1982 | Wood | |
| 4,394,903 | A | | 7/1983 | Bakx | |
| 4,398,631 | A | | 8/1983 | Graser | |
| 4,421,232 | A | | 12/1983 | Konaka | |
| 4,424,901 | A | | 1/1984 | Lanier | |
| 4,437,569 | A | | 3/1984 | Sorenson | |
| 4,437,606 | A | | 3/1984 | Graser | |
| 4,438,843 | A | | 3/1984 | Graser | |
| 4,463,852 | A | | 8/1984 | Stone | |
| 4,465,180 | A | | 8/1984 | Klygis | |
| 4,470,503 | A | | 9/1984 | Stone | |
| 4,498,618 | A | | 2/1985 | Sutherland | |
| 4,505,696 | A | | 3/1985 | Wright et al. | |
| 4,533,047 | A | | 8/1985 | Calvert | |
| 4,545,485 | A | | 10/1985 | Oliff | |
| 4,574,997 | A | | 3/1986 | Ikeda | |
| 4,597,523 | A | | 7/1986 | Schuster | |
| 4,600,140 | A | | 7/1986 | Milliens | |
| 4,708,284 | A | | 11/1987 | Sutherland et al. | |
| 4,773,533 | A | | 9/1988 | Greene | |
| 4,883,168 | A | | 11/1989 | Dreyfus | |
| 4,890,737 | A | | 1/1990 | Kadleck et al. | |
| 4,890,738 | A | | 1/1990 | Carer | |
| 4,919,266 | A | | 4/1990 | McIntosh, Jr. et al. | |
| 4,925,019 | A | | 5/1990 | Ganz et al. | |
| 5,002,186 | A | | 3/1991 | Cooper | |
| D316,672 | S | | 5/1991 | Wood | |
| 5,020,668 | A | | 6/1991 | Schuster | |
| 5,022,525 | A | | 6/1991 | Schuster | |
| 5,080,280 | A | | 1/1992 | Kraus | |
| 5,131,588 | A | | 7/1992 | Oliff | |
| 5,145,067 | A | | 9/1992 | Carver | |
| 5,158,177 | A | | 10/1992 | Negelen et al. | |
| 5,167,325 | A | | 12/1992 | Sykora | |
| 5,246,112 | A | | 9/1993 | Stout et al. | |
| 5,297,673 | A | | 3/1994 | Sutherland | |
| 5,310,050 | A | | 5/1994 | Sutherland | |
| 5,311,984 | A | | 5/1994 | Harris | |
| 5,328,080 | A | | 7/1994 | Holley, Jr. | |
| 5,360,104 | A | | 11/1994 | Sutherland | |
| 5,360,113 | A | | 11/1994 | Harris | |
| 5,385,234 | A | | 1/1995 | Stout et al. | |
| 5,390,784 | A | | 2/1995 | Sutherland | |
| 5,390,848 | A | | 2/1995 | Gungner et al. | |
| 5,437,363 | A | | 8/1995 | Gungner | |
| 5,439,112 | A | | 8/1995 | De Guglielmo et al. | |
| 5,443,203 | A | | 8/1995 | Sutherland | |
| 5,472,090 | A | | 12/1995 | Sutherland | |
| 5,476,217 | A | | 12/1995 | Moncrief et al. | |
| 5,549,197 | A | | 8/1996 | Sutherland | |
| 5,579,904 | A | | 12/1996 | Holley, Jr. | |
| 5,582,289 | A | | 12/1996 | Wright | |
| 5,595,291 | A | | 1/1997 | Negelen | |
| 5,595,292 | A | | 1/1997 | Bates | |
| 5,595,299 | A | | 1/1997 | LeBras | |
| 5,605,228 | A | | 2/1997 | Baxter | |
| 5,653,340 | A | | 8/1997 | Daniel | |
| 5,671,845 | A | | 9/1997 | Harris | |
| 5,699,957 | A | | 12/1997 | Blin et al. | |
| 5,765,685 | A | | 6/1998 | Roosa | |
| 5,775,572 | A | | 7/1998 | Oliff | |
| 5,941,389 | A | | 8/1999 | Gomes | |
| 5,947,367 | A | | 9/1999 | Miller et al. | |
| 5,975,286 | A | | 11/1999 | Oliff | |
| 5,975,287 | A | | 11/1999 | Negelen | |
| 5,979,645 | A | | 11/1999 | Holley, Jr. | |
| 5,984,086 | A | | 11/1999 | Fousghee et al. | |
| 6,155,412 | A | | 12/2000 | LeBras et al. | |
| 6,170,741 | B1 | | 1/2001 | Skolik et al. | |
| 6,189,687 | B1 | | 2/2001 | Bakx | |
| 6,213,297 | B1 | | 4/2001 | Gale | |
| 6,241,083 | B1 | | 6/2001 | Harrelson | |
| 6,247,585 | B1 | | 6/2001 | Holley, Jr. | |
| 6,273,330 | B1 | | 8/2001 | Oliff et al. | |
| 6,295,789 | B1 | | 10/2001 | Muller | |
| 6,315,111 | B1 | | 11/2001 | Sutherland | |
| 6,315,123 | B1 | | 11/2001 | Ikeda | |
| 6,536,656 | B2 | | 3/2003 | Auclair et al. | |
| 6,615,984 | B2 | | 9/2003 | Saulas et al. | |
| 6,669,083 | B2 | | 12/2003 | Bates | |
| 6,695,137 | B2 | | 2/2004 | Jones et al. | |
| 6,877,600 | B2 | | 4/2005 | Sutherland | |
| 6,896,130 | B2 | | 5/2005 | Theelen | |
| 6,948,293 | B1 | | 9/2005 | Eckermann et al. | |
| 6,983,874 | B2 | | 1/2006 | Bakx | |
| 6,997,372 | B2 | | 2/2006 | Gasparowicz | |
| 7,028,839 | B2 | | 4/2006 | Belloli et al. | |
| 7,048,113 | B2 | | 5/2006 | Gomes | |
| 7,063,208 | B2 | | 6/2006 | Lebras | |
| 7,070,045 | B2 | | 7/2006 | Theelen | |
| 7,134,547 | B2 | | 11/2006 | Auclair | |
| 7,175,020 | B2 | | 2/2007 | Sutherland et al. | |
| 7,234,591 | B2 | | 6/2007 | LeBras et al. | |
| 7,374,038 | B2 | | 5/2008 | Smalley | |
| 7,427,010 | B2 | | 9/2008 | Sutherland | |
| 7,467,729 | B2 | | 12/2008 | Lown et al. | |
| 7,780,067 | B2 | | 8/2010 | Holley, Jr. | |
| 7,913,844 | B2 | | 3/2011 | Spivey, Sr. | |
| 8,061,587 | B2 | | 11/2011 | Blin | |
| 8,070,052 | B2 | | 12/2011 | Spivey, Sr. | |
| 2004/0000494 | A1 | | 1/2004 | Sutherland | |
| 2004/0164135 | A1 | | 8/2004 | Gong et al. | |
| 2007/0056869 | A1 | | 3/2007 | Tokarski | |
| 2007/0181658 | A1 | | 8/2007 | Sutherland | |

(56) References Cited

U.S. PATENT DOCUMENTS

| | | | | |
|---|---|---|---|---|
| 2007/0215682 | A1 | 9/2007 | Bates et al. | |
| 2007/0277481 | A1 | 12/2007 | LeBras | |
| 2008/0203143 | A1 | 8/2008 | Holley | |
| 2008/0257942 | A1 | 10/2008 | LeBras | |
| 2009/0032425 | A1 | 2/2009 | Perkinson | |
| 2009/0065559 | A1 | 3/2009 | Parkes | |
| 2009/0101526 | A1 * | 4/2009 | Sutherland et al. | 206/148 |
| 2009/0236408 | A1 | 9/2009 | Spivey, Sr. et al. | |
| 2010/0140336 | A1 | 6/2010 | Ho Fung | |
| 2011/0011924 | A1 | 1/2011 | Spivey, Sr. et al. | |
| 2011/0065558 | A1 | 3/2011 | Smalley | |
| 2011/0233091 | A1 | 9/2011 | Block et al. | |
| 2011/0284622 | A1 | 11/2011 | Boukredine | |
| 2011/0290867 | A1 | 12/2011 | Schemmel et al. | |
| 2012/0279897 | A1 | 11/2012 | Schmal et al. | |

FOREIGN PATENT DOCUMENTS

| | | | |
|---|---|---|---|
| EP | 630 825 | A2 | 12/1994 |
| EP | 0 901 969 | B1 | 4/2000 |
| EP | 1 065 151 | A1 | 1/2001 |
| EP | 1 103 481 | B1 | 8/2004 |
| EP | 1 010 637 | B1 | 9/2004 |
| EP | 1 125 858 | B1 | 9/2004 |
| EP | 1 381 545 | B1 | 10/2005 |
| EP | 1 334 043 | B1 | 12/2005 |
| EP | 1 151 935 | B1 | 8/2006 |
| EP | 1 513 737 | B1 | 11/2006 |
| EP | 2 055 648 | A1 | 5/2009 |
| EP | 1 749 755 | B1 | 12/2011 |
| JP | 11-124129 | A | 5/1999 |
| JP | 3039805 | | 3/2000 |
| JP | 2008 213894 | A | 9/2008 |
| JP | 2009-120248 | | 6/2009 |
| KR | 20-2010-0010124 | | 10/2010 |
| WO | WO 92/09498 | | 6/1992 |
| WO | WO 93/14991 | A1 | 8/1993 |
| WO | WO 95/08489 | A1 | 3/1995 |
| WO | WO 2005/042370 | A1 | 5/2005 |
| WO | WO 2011/022145 | A1 | 2/2011 |
| WO | WO 2011/049947 | A1 | 4/2011 |

* cited by examiner

CARTON WITH ARTICLE PROTECTION FEATURE

CROSS-REFERENCE TO RELATED APPLICATIONS

This application claims the benefit of U.S. Provisional Patent Application No. 61/741,315, filed Jul. 17, 2012. This application is related to U.S. patent application Ser. No. 13/419,740, filed Mar. 14, 2012, which claims the benefit of U.S. Provisional Application No. 61/518,504, filed May 6, 2011, U.S. Provisional Application No. 61/572,638, filed Jul. 19, 2011, U.S. Provisional Application No. 61/272,249, filed Oct. 7, 2011, U.S. Provisional Application No. 61/548,779, filed Oct. 19, 2011, and U.S. Provisional Application No. 61/570,044, filed Dec. 13, 2011.

INCORPORATION BY REFERENCE

The entire contents of U.S. Provisional Patent Application No. 61/741,315, filed Jul. 17, 2012, U.S. patent application Ser. No. 13/419,740, filed Mar. 14, 2012, U.S. Provisional Application No. 61/518,504, filed May 6, 2011, U.S. Provisional Application No. 61/572,638, filed Jul. 19, 2011, U.S. Provisional Application No. 61/272,249, filed Oct. 7, 2011, U.S. Provisional Application No. 61/548,779, filed Oct. 19, 2011, and U.S. Provisional Application No. 61/570,044, filed Dec. 13, 2011, are hereby incorporated by reference as if presented herein in their entirety.

BACKGROUND OF THE DISCLOSURE

The present disclosure generally relates to cartons for holding beverage containers or other types of articles. More specifically, the present disclosure relates to cartons having an article retention feature and/or other features that protect the containers or articles from breakage.

SUMMARY OF THE DISCLOSURE

In one aspect, the disclosure is generally directed to a carton for containing at least one article. The carton includes a plurality of panels that extends at least partially around the interior of the carton. The plurality of panels comprises a top panel, a bottom panel, a first side panel, and a second side panel. At least one article retention panel is for retaining the at least one article. The article retention panel is foldably connected to the at least one panel. The article retention panel is positioned relative to the at least one panel to contact the at least one article.

In another aspect, the disclosure is generally directed to a blank for forming a carton for containing at least one article. The blank includes a plurality of panels that extends at least partially around the interior of the carton. The plurality of panels comprises a top panel, a bottom panel, a first side panel, and a second side panel. At least one article retention panel is for retaining the at least one article. The article retention panel is foldably connected to the at least one panel. The article retention panel is positioned relative to the at least one panel to contact the at least one article in the carton formed from the blank.

In another aspect, the disclosure is generally directed to a method of forming a carton for containing at least one article. The method comprising obtaining a blank comprising a plurality of panels that extends at least partially around the interior of the carton. The plurality of panels comprising a top panel, a bottom panel, a first side panel, and a second side panel. At least one article retention panel is foldably connected to the at least one panel. The method comprises forming an interior of the carton at least partially defined by the plurality of panels and loading at least one article in the interior. Then positioning the at least one article retention panel relative to the at least one panel to contact at least one article in the carton after the loading of the at least one article. The positioning comprises moving the article retention panel from a first position that is substantially parallel to the main portion to a second position wherein the article retention panel is folded relative to the main portion.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to cartons that contain a single article or a plurality of articles such as containers, bottles, cans, etc., and retention panels for securing and protecting the article or articles or containers from breakage, damage, or deformation. The article(s) can be used for packaging food and beverage products, for example, or any other item. The article(s) can be made from materials suitable in composition for packaging the particular food or beverage item, or other item, and the materials can include, but are not limited to, glass or other breakable material; aluminum and/or other metals; plastics such as PET, LDPE, LLDPE, HDPE, PP, PS, PVC, EVOH, and Nylon; paperboard; and the like, or any combination thereof, or any other suitable material.

Some of the various features disclosed may be similar to any of the embodiments disclosed in the above-noted incorporated by reference patent applications, including U.S. patent application Ser. No. 13/419,740 and all related applications. Further, some of the various features disclosed herein may be combined with features disclosed in the '740 application to restrain movement of the containers in the carton.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "lower," "bottom," "upper" and "top" indicate orientations determined in relation to fully erected and upright cartons.

Figure 1:
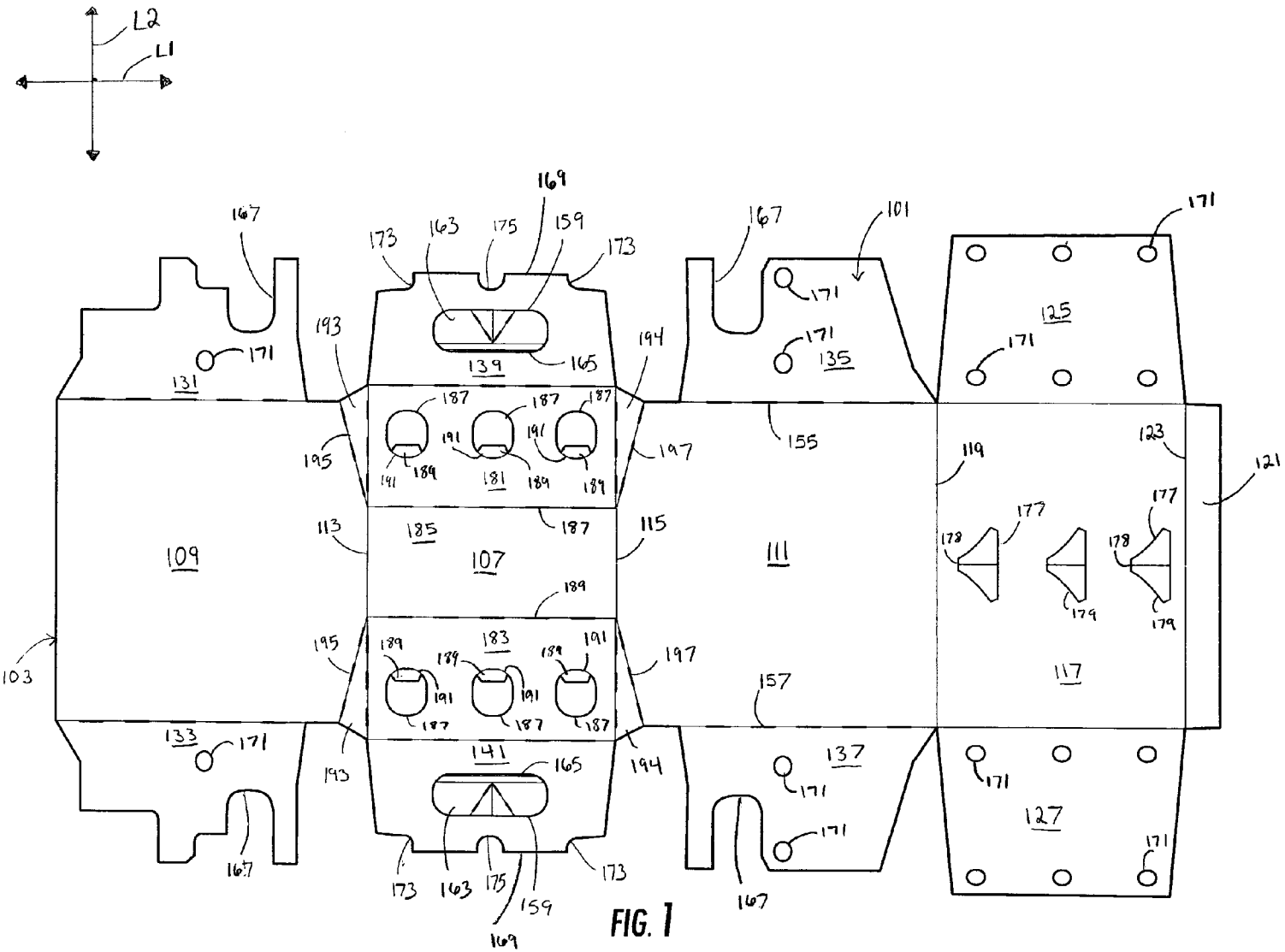
FIG. 1 is a plan view of an exterior surface of a blank for forming a carton according to a first embodiment of the disclosure.
Figure 2:
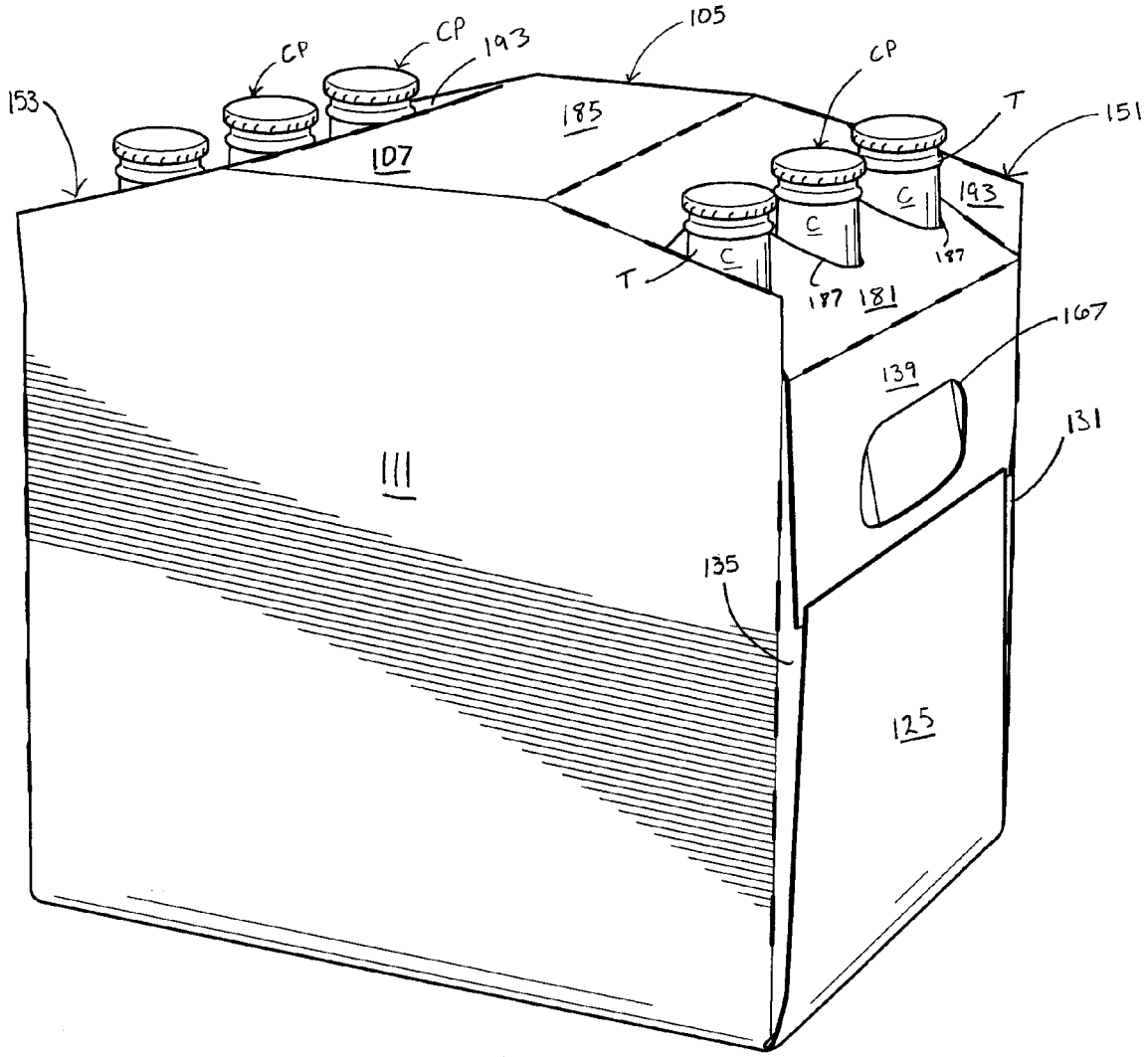
FIGS. 2-4 are perspective views of the assembled carton of the first embodiment.

FIG. 1 is a plan view of the exterior side 101 of a blank, generally indicated at 103, used to form a carton 105 (FIG. 2) according to a first exemplary embodiment of the disclosure. The carton 105 can be used to house a plurality of articles such as containers C (FIG. 2). In the illustrated embodiment, the containers C are bottles having a wide bottom B and a narrow top T including a cap CP. In the illustrated embodiment, the carton 105 is sized to house twelve containers C in a single layer in a 3×4 arrangement, but it is understood that the carton 105 may be sized and shaped to hold containers of a different or same quantity in more than one layer and/or in different row/column arrangements (e.g., 1×6, 2×6, 4×6, 3×8, 2×6×2, 3×4×2, 2×9, 3×4, etc.), or just a single article.

The blank 103 has a longitudinal axis L1 and a lateral axis L2. In the embodiment of FIG. 1, the blank includes a top panel 107 foldably connected to side panels 109, 111 at a lateral fold lines 113, 115. A bottom panel 117 is foldably connected to the second side panel 111 at a lateral fold line 119, and foldably connected to an adhesive panel 121 at a lateral fold line 123.

In one embodiment, the bottom panel 117 is foldably connected to a first bottom end flap 125 and a second bottom end flap 127. The first side panel 109 is foldably connected to side end flaps 131, 133. The second side panel 111 is foldably connected to side end flaps 135, 137. The top panel 107 is foldably connected to a first top end flap 139 and a second top end flap 141. In one embodiment, when the carton 105 is erected, the end flaps 125, 131, 135, 139, close the first end 151 of the carton, and the end flaps 127, 133, 137, 141 close the second end 153 of the carton 105. In accordance with an alternative embodiment of the present disclosure, different flap arrangements can be used for closing the ends 151, 153 of the carton 105.

In the illustrated embodiment, the end flaps 125, 131, 135, 139 extend along a first marginal area of the blank 103, and are foldably connected at a first longitudinal fold line 155 that extends along the length of the blank. The end flaps 127, 133, 137, 141 extend along a second marginal area of the blank 103, and are foldably connected at a second longitudinal fold line 157 that also extends along the length of the blank 103. The longitudinal fold lines 155, 157 may be, for example, substantially straight, or offset at one or more locations to account for blank thickness or for other factors.

In the embodiment of FIG. 1, the blank 103 has handle features for a forming handle 159. In the illustrated embodiment, the handle features comprise handle flaps 163 foldably connected to respective top end flaps 139, 141 at a longitudinal fold line 165, and notches or openings 167 in the side end flaps 131, 133, 135, and 137. The openings 167 cooperate to provide an opening at a respective closed end 151, 153 to allow a respective handle flap 163 to be inwardly folded so that the carton 105 can be grasped at a respective end. The blank 103 can have other features for forming the handle 159, or the blank and/or carton 105 can have a handle that is alternatively shaped, arranged, and/or configured without departing from the disclosure. Further, the handle 159 can be omitted without departing from the disclosure.

In one embodiment, the blank 103 has features for forming the article protection features (not shown) of the carton 105. As shown in FIG. 1, the side end flaps 131, 133, 135, 137 have deformations in the form of indentations 171 on the exterior surface 101 of the blank 103 such that the indentations from a protrusion on the interior surface of the blank. The bottom end flaps 125, 127 each have two rows of deformations in the form of indentations 171 on the interior surface of the blank 103 such that the indentations on the interior surface form a protrusion on the exterior surface 101 of the blank 103. As shown in FIG. 1, the top end flaps 139, 141 each have a respective distal edge 169 having corner notches 173 and a center notch 175. The indentations 171 can be any deformation on a surface of a respective side end flaps 131, 133, 135, 137 or bottom end flap 125, 127 such that the deformation can be any suitable shape (e.g., a concave depression or protrusion, convex depression or protrusion, flat depression or protrusion, embossed area, debossed area, etc., or any other suitable shape). Furthermore, the indentations 171 could be formed on the interior or exterior surface of one or more of the first side panel 109, second side panel 111, top panel 107, bottom panel 117, or top end flaps 139, 141 without departing from the disclosure. The blank 103 can have other protection features that are alternatively shaped, arranged, and/or configured without departing from the disclosure. Further, the article protection features can be omitted without departing from the disclosure.

In the illustrated embodiment, the blank 103 includes three article protection flaps 177 arranged in a 1×3 arrangement and foldably connected to the bottom panel 117, but the blank 103 could have more or less than three article protection flaps 177, and the flaps 177 could be otherwise arranged in other suitable row/column arrangements or in a random configuration on the bottom panel 117, including a multiple row or a multiple column configuration, or any other suitable configuration. The article protection flaps 177 are each foldably connected to the bottom panel 117 at a respective lateral fold line 178 and are each at least partially defined by a line of weakening 179 in the bottom panel 117. In one embodiment, the line of weakening 179 is a cut, but the line of weakening could comprises other forms of weakening (e.g., a tear line that comprises cut lines separated by breakable nicks, a tear line that is formed by a series of spaced apart cuts, etc.) that allows the article protection flap 177 to separate from the bottom panel 117 without departing from the disclosure. In other embodiments, the blank 103 can include article protection flaps 177 that are different, similar, or identical to the article protection flaps 177 without departing from the disclosure. The article protection flaps 177 could be otherwise shaped, arranged, configured, and/or omitted without departing from the disclosure.

In one embodiment, the blank 103 has panels 181, 183 for retaining one or more articles. As shown in FIG. 1, the panels 181, 183 for retaining one or more articles include a first retention panel 181 and second retention panel 183. The first retention panel 181 is foldably connected to a main portion 185 of the top panel 107 along longitudinal fold line 187 and foldably connected to a first top end flap 139 along longitudinal fold line 155. The second retention panel 183 is foldably connected to the main portion 185 of the top panel 107 along longitudinal fold line 189 and foldably connected to a second top end flap 141 along longitudinal fold line 157. In one embodiment, the main portion 185 of the top panel 107 is a central portion near the centerline of the blank, but the top panel 107 could otherwise be shaped, arranged and/or configured. Alternatively, the main portion 185 could be omitted and the two retention panels 181, 183 could be foldably connected to each other without departing from the disclosure.

As illustrated in FIG. 1, the first and second article retention panels 181, 183 each comprise three openings in a 1×3 configuration. In one embodiment the openings 187 are substantially circular and sized accordingly to receive the top of a container such as a bottle. The openings 187 contain retaining tabs 189 foldably connected to the retention panel at a fold line 191. The retaining tabs 189 extend at least partially into the opening 187. When a top of a bottle is inserted into the opening 187 the retaining tab 189 contacts the bottle and secure the container substantially preventing movement of the bottle. The openings 187 and retaining tabs 189 could be otherwise shaped, arranged, and positioned without departing from the disclosure. For example the retaining tabs 189 could be flaps that are detachably connected to the retention panels 181, 183 at a tear line so that the flaps separate from the retention panel where the containers are inserted through the openings.

In one embodiment, the blank includes four gussets 193, 194, one on each side of the first and second retention panels 181, 183. Two of the gussets 193 are respectively foldably connected to first and second retention panels 181, 183 at the fold lines 113 and to the first side panel at oblique fold lines 195. The other two gussets 194 are respectively foldably connected to first and second retention panels 181, 183 at fold line 115, and to the second side panel 111 at oblique fold lines 197. The gusset panels 193, 194, are generally triangular panels, but the gusset panels 193, 194 and fold lines 113, 115, 195, 197 could be otherwise shaped, arranged, and positioned without departing from the disclosure.

Figure 3:
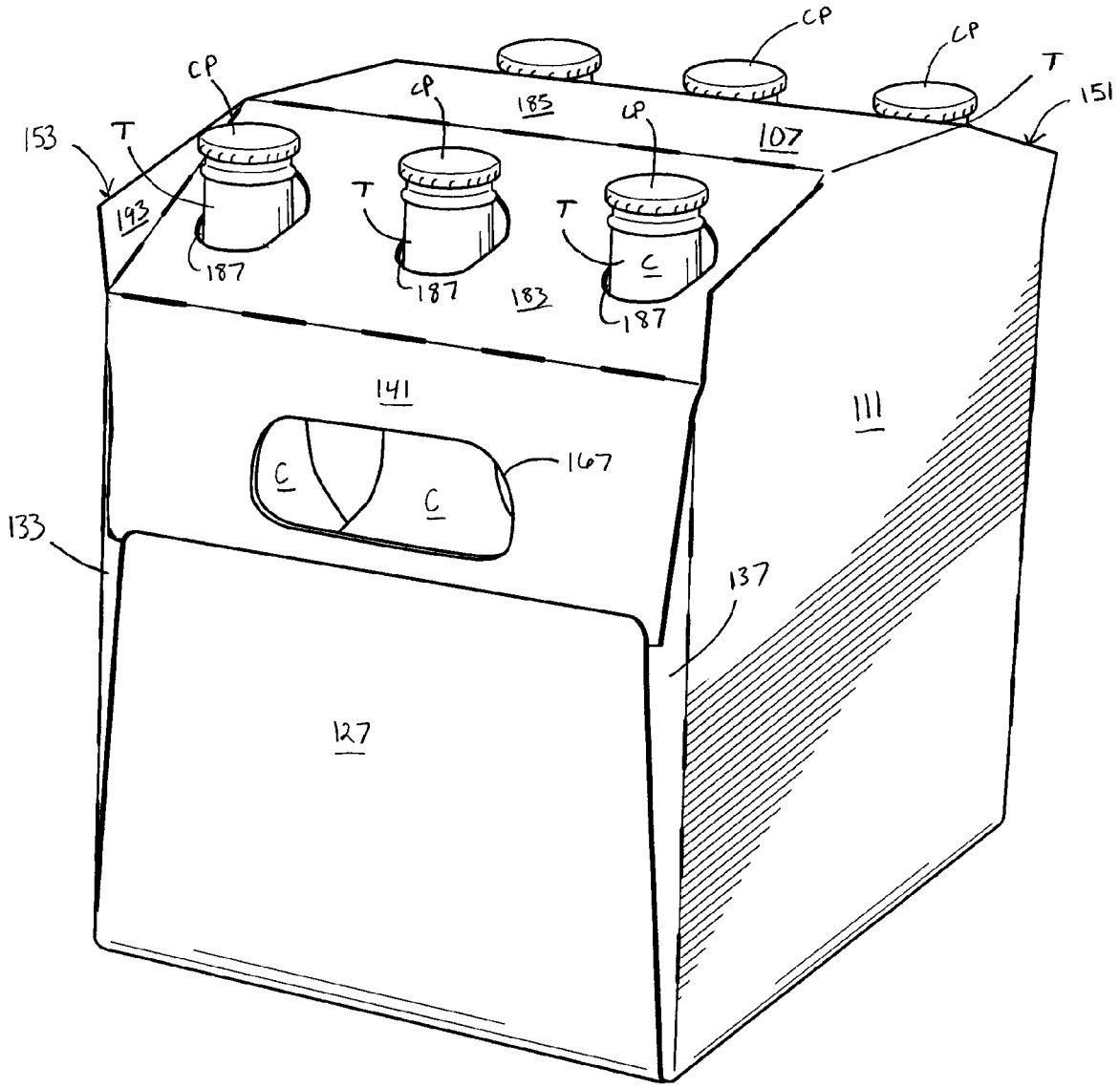
Figure 4:
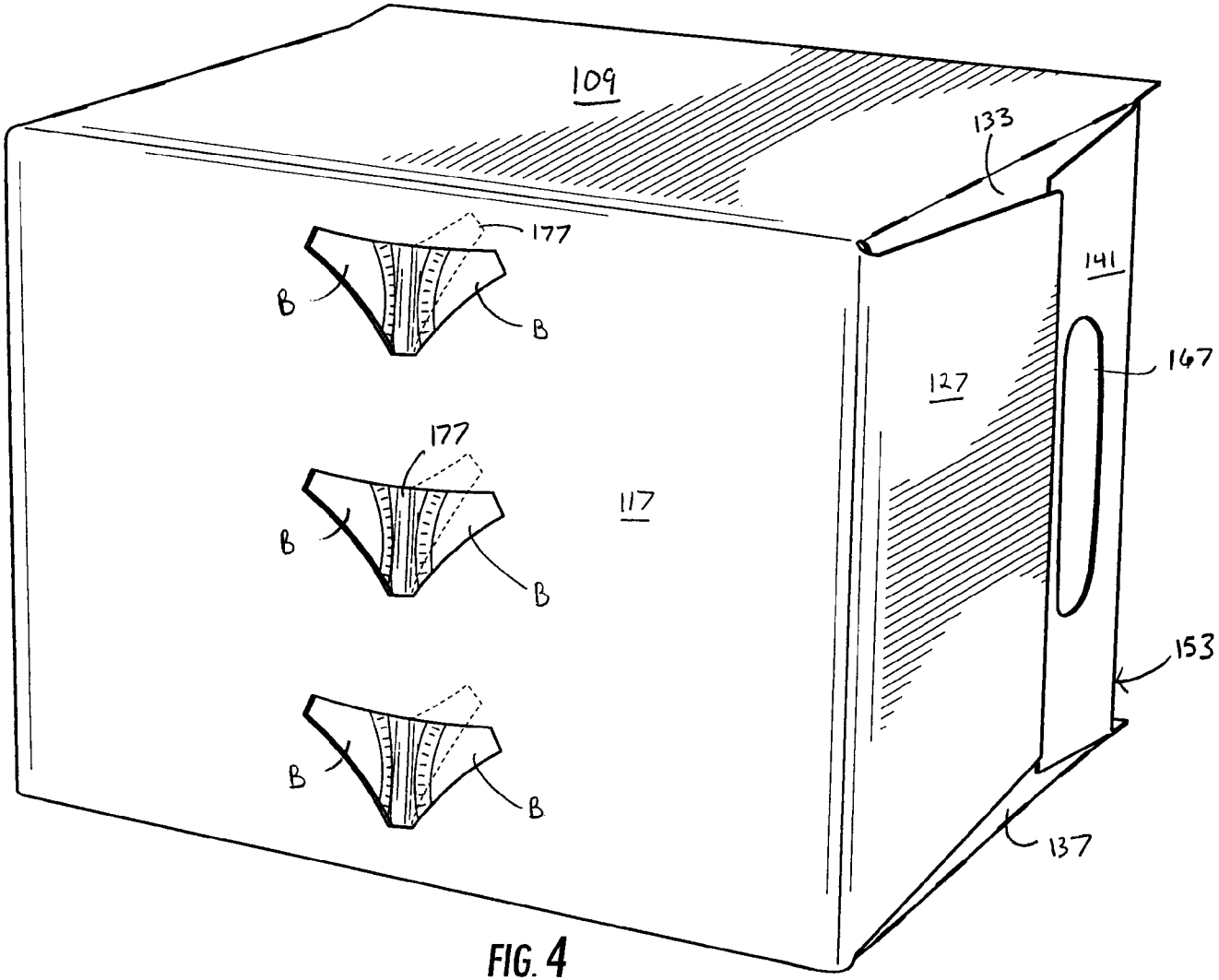

FIGS. 2-4 show one exemplary erected carton formed from the blank 103 with bottles secured in the openings of the article retention panels 181, 183. At various stages of the erecting process, glue or other adhesive can be applied to various portions of the blank 103. As shown in FIG. 2, the blank 103 can be formed into a carton 105 by first forming a sleeve by folding the bottom panel 117, side panels 109, 111, and top panel 107 along respective fold lines 113, 115, 119. The adhesive panel 121 can be adhesively secured to the first side panel 109 by glue or other suitable adhesive. Containers C can be placed into an interior space of the sleeve. One of the ends 151, 153 can be closed prior to loading the containers C or both of the ends 151, 153 can be closed after loading the containers into the interior space. The closing of the first end 151 is described below, but it is understood that the second end 153 can be closed in a similar manner, with the article retention panel 183 in the second end 153 being formed in a similar manner as the article retention panel 181 in the first end 151. Alternatively, the second end 153 could have different flap closing sequence or arrangement and the article retention panels 181, 183 could be otherwise shaped, arranged, and/or configured without departing from the disclosure.

In one embodiment, the first end 151 is closed by inwardly folding the side end flaps 131, 135. As shown in FIGS. 2-4, the first article retention panel 181 is downwardly folded along fold line 187 such that the top of the containers are inserted through the openings 187 and in contact with the retaining tabs 189 in the first article retention panel 181. The first top end flap 139 is downwardly folded and the first bottom end flap 125 is upwardly folded to close the end 151 of the carton 105.

In one embodiment, the second end 153 is closed by inwardly folding the side end flaps 133, 137. As shown in FIGS. 2-4, the second article retention panel 187 is downwardly folded along fold line 189 such that the tops of the containers C are inserted through the openings 187 and in contact with the retaining tabs 189 in the second article retention panel 183. The second top end flap 141 is downwardly folded and the second bottom end flap 127 is upwardly folded to close the end 153 of the carton 105.

In one embodiment the indentations 171 on the exterior surface 101 of the side end flaps 131, 133, 135, 137 are aligned with the indentations 171 on the interior surface of the bottom end flap 125, 127 to form a respective article protection feature when the carton is being closed.

In the one embodiment, the loaded and closed carton 105 is further processed so that the article protection flaps 177 are activated to provide a cushion between the containers inside the carton and further secure the containers to prevent breaking. The article protection flaps 177 are foldably connected to the bottom panel 117 and movable between a first position (that is substantially parallel to the bottom panel) and a second position wherein the article protection flaps are folded upwardly relative to the bottom panel. In one embodiment, the article protection flaps 177 are raised or activated and the article protection flaps have features for preventing the folding of the article protection flaps from the second position back to the first position. It is understood that the article protection flaps 177 will be activated to the second position (FIG. 4) after the ends 151, 153 of the carton 105 have been closed. Alternatively, the article protection flaps 177 could be activated prior to closing one or both of the ends 151, 153 of the carton 105 without departing from the disclosure.

Figure 5:
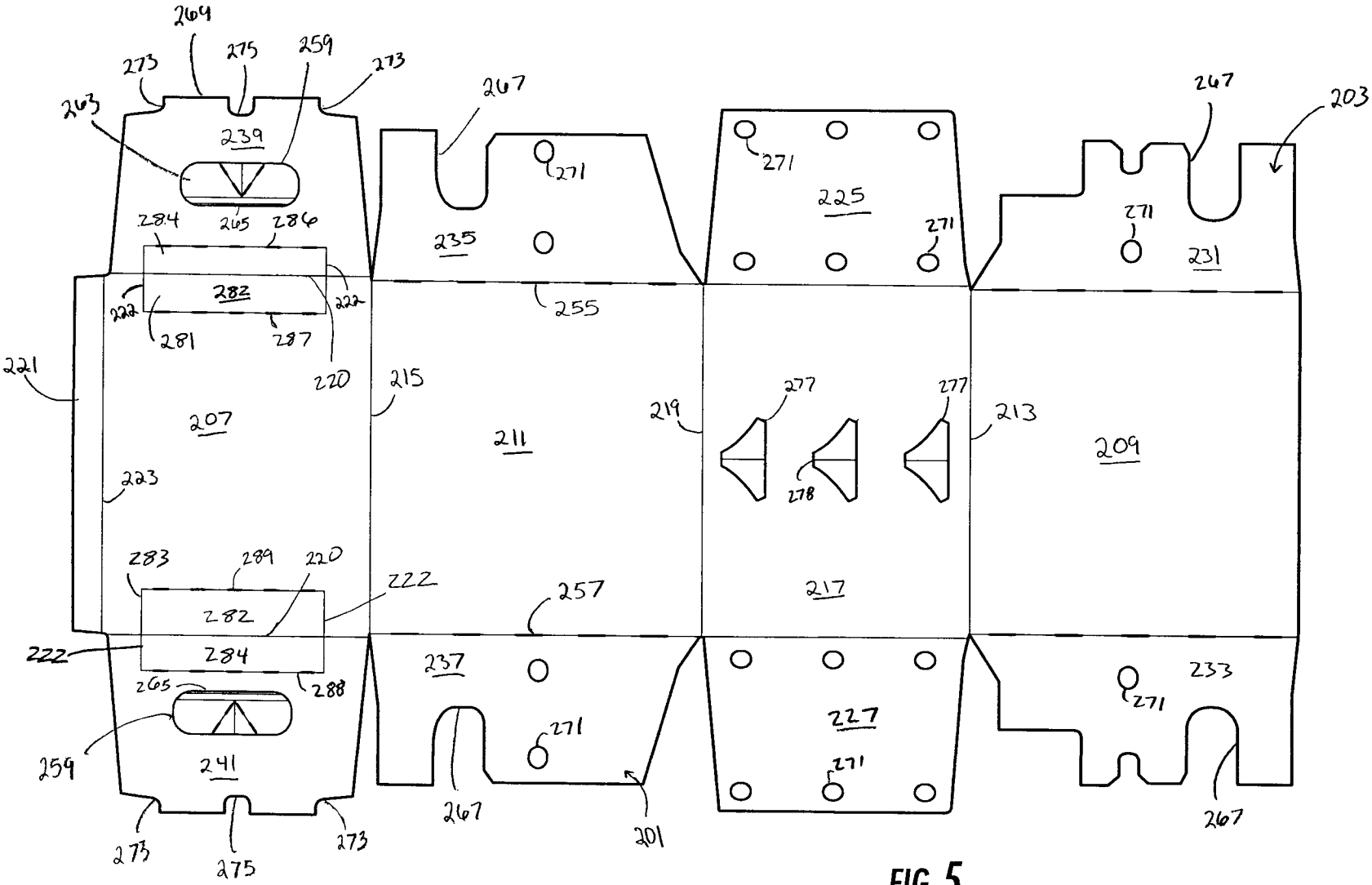
FIG. 5 is a plan view of an exterior surface of a blank for forming a carton according to a second embodiment of the disclosure.
Figure 6:
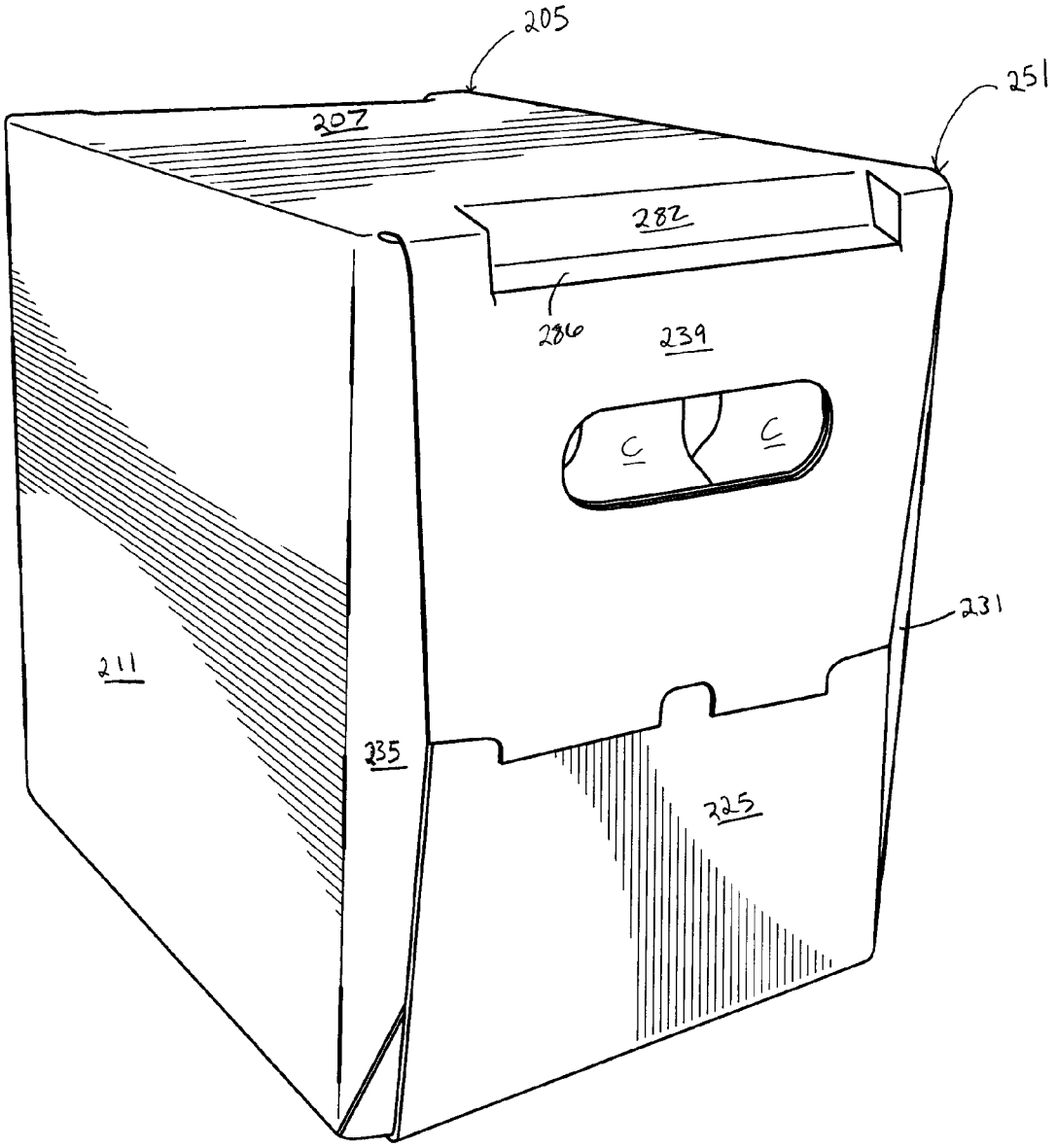
FIGS. 6-7 are perspective views of the assembled carton of the second embodiment.
Figure 7:
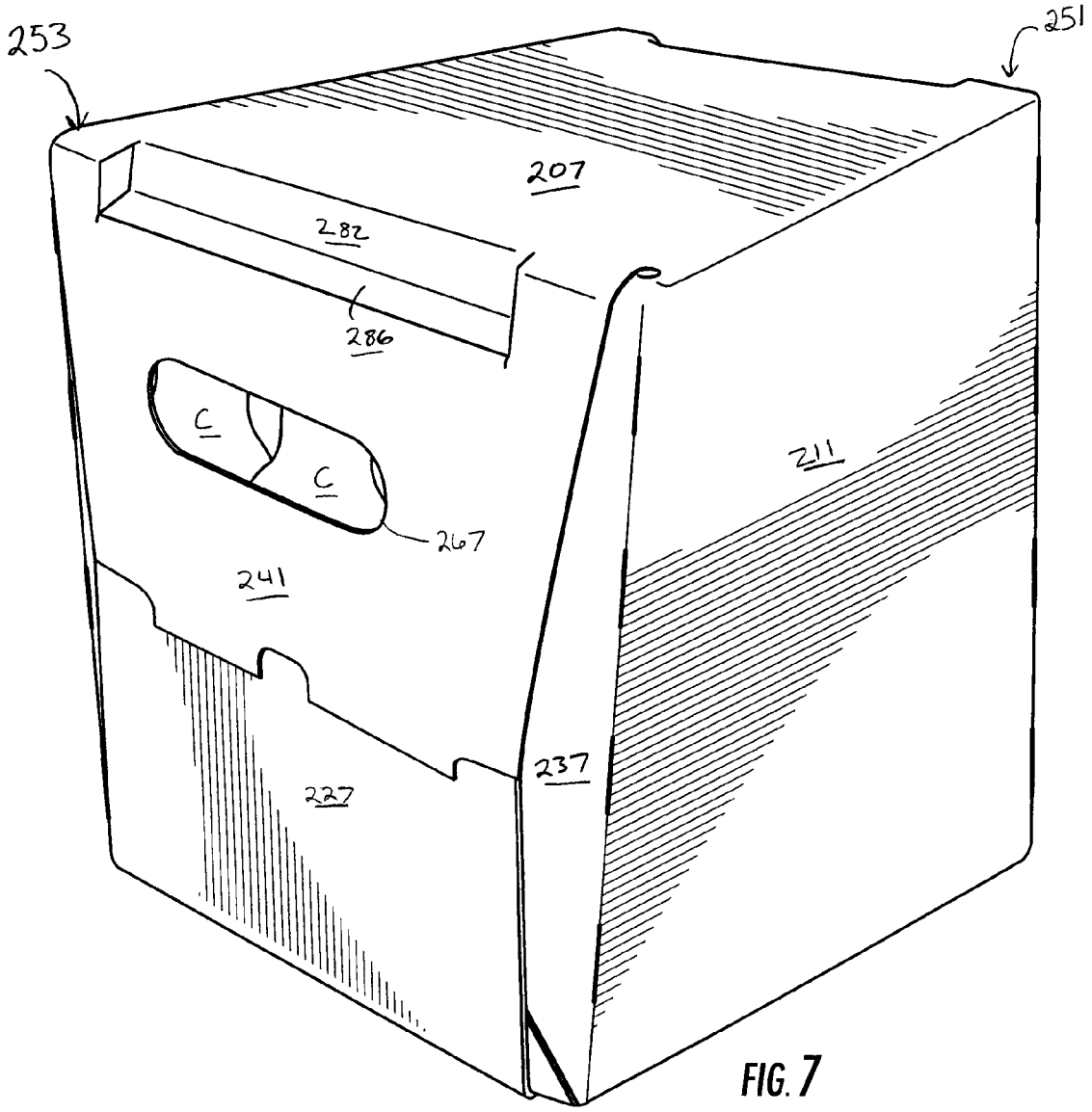

FIGS. 5-7 illustrate various features of a blank 203 for forming a carton 205 of an alternative embodiment having similar features as the first embodiment of the disclosure. Accordingly, similar or identical features of the embodiments are provided with like reference numbers. In the illustrated embodiment, the blank 203 has a top panel 207, bottom panel 217, and respective side panels 209, 211 for forming the sides of the carton 205. The blank 203 has two retention panels 281, 283 that inwardly fold to retain containers stored inside when the carton is erected from the blank.

In a second embodiment the top panel 207 is foldably connected to the second side panel 211 at a lateral fold line 215, and foldably connected to an adhesive panel 221 at a lateral fold line 223. The bottom panel 217 is foldably connected to the first side panel 209 and the second side panel 211 at lateral fold lines 213, 219.

The bottom panel 217 is foldably connected to a first bottom end flap 225 and a second bottom end flap 227. The first side panel 209 is foldably connected to a first side end flap 231 and a second side end flap 233. The second side panel 211 is foldably connected to a first side end flap 235 and a second side end flap 237. The top panel 207 is foldably connected to a first top end flap 239 and a second top end flap 241. In one embodiment, when the carton 205 is erected, the end flaps 225, 231, 235, 239, close the first end 251 of the carton, and the end flaps 227, 233, 237, 241 close the second end 253 of the carton. In accordance with an alternative embodiment of the present disclosure, different flap arrangements can be used for closing the ends 251, 253 of the carton 205.

In the illustrated embodiment, the end flaps 225, 231, 235, 239 extend along a first marginal area of the blank 203, and are foldably connected at a first longitudinal fold line 255 that extends along the length of the blank 203. The end flaps 227, 233, 237, 241 extend along a second marginal area of the blank 203, and are foldably connected at a second longitudinal fold line 257 that also extends along the length of the blank 203. The longitudinal fold lines 255, 257 may be, for example, substantially straight, or offset at one or more locations to account for blank thickness or for other factors.

In one embodiment of the disclosure, the blank 203 comprises two retention panels 281, 283. The retention panels 281, 283 have a first portion 282 foldably connect to the top panel 207 along a longitudinal fold lines 287, 289 and a second portion 284 foldably connected to the top end flaps 239, 241 along a second longitudinal fold line 286, 288. The first portion 282 is foldably connected to the second portion 284 along a third longitudinal fold line 220. The edges of the retention panels are formed cuts 222 that extend from the first fold line to the second fold line. The cuts 222 could be other lines of weakness (e.g., openings, slits, tear lines, or any other lines of weakness) without departing from the disclosure.

FIGS. 6-7 show one exemplary erected carton formed from the blank 203 with bottles retained in the article retention panels. The blank 203 can be formed into a carton 205 by first forming a sleeve by folding the bottom panel 217, side panels 209, 211, and top panel 207 along respective fold lines 213, 215, 219. The adhesive panel 221 can be adhesively secured to the first side panel 209 by glue or other suitable adhesive. Containers C can be placed into an interior space of the sleeve. One of the ends 251, 253 can be closed prior to loading the containers C or both of the ends 251, 253 can be closed after loading the containers into the interior space. The first end is closed by inwardly folding the side end flaps 231, 235. The first bottom end flap 225 is upwardly folded and the first top end flap 239 is downwardly folded to close the end 251 of the carton 205. The second end 253 is closed similarly by inwardly folding the side end flaps 233, 237. The second bottom end flap 227 is upwardly folded and the second top end flap is downwardly folded to close the end 253 of the carton 205. Alternatively, the flaps can be folded in a different order without departing from the present disclosure.

In the illustrated embodiment, the article retention panels 281, 283 are activated by inwardly folding the first portion 282 along lateral fold lines 287, 289 from a first position that is substantially parallel to the top panel 207, to a second position that is substantially perpendicular to the top panel 207. The second portions 284 are inwardly folded along lateral fold lines 286, 288 from a first position that is substantially parallel to the top end flap 239, 241 to a second position that is substantially perpendicular to the top end flap 239, 241. The article retention panels 281, 283 are folded to be in contact with and secure the containers C inside the carton 205. In the activated or inwardly folded position, the first portion 282 and the second portion 284 of the article retention panel forms a support structure having an L-shaped cross-section. The article retention panels 281, 283 could be otherwise shaped, arranged, and/or configured without departing from the disclosure.

Figure 8:
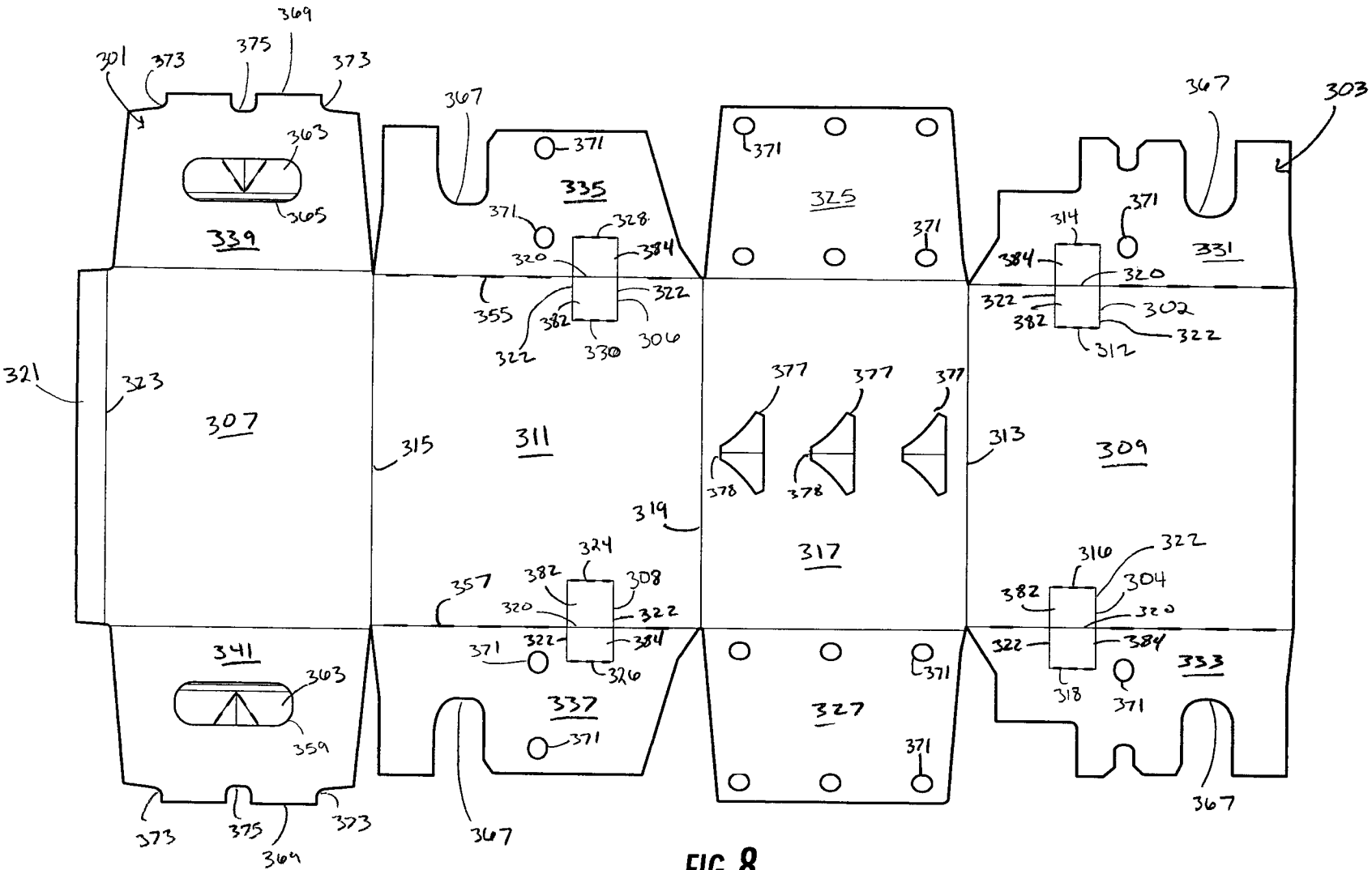
FIG. 8 is a plan view of an exterior surface of a blank for forming a carton according to a third embodiment of the disclosure
Figure 9:
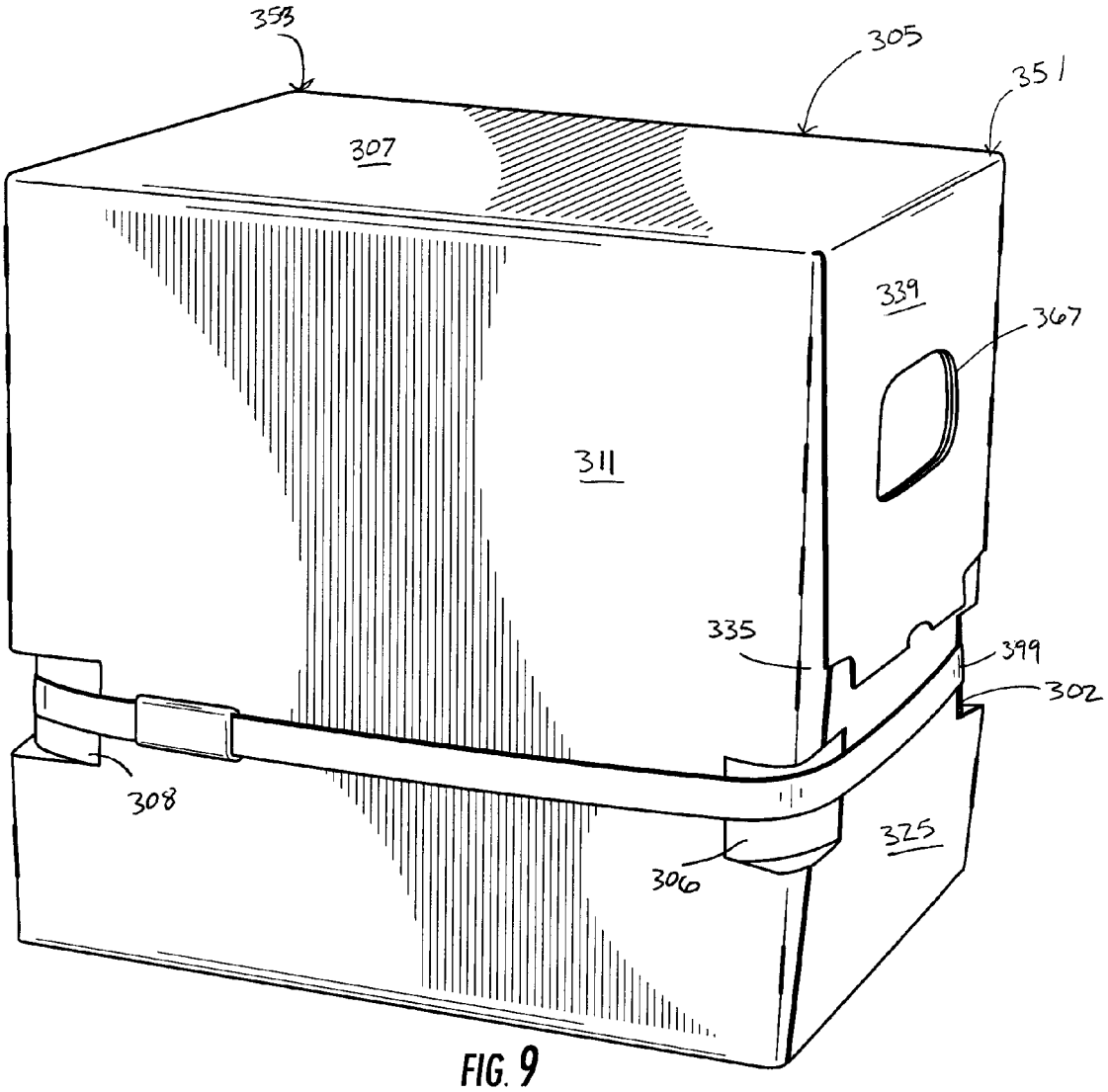
FIGS. 9-10 are perspective views of the assembled carton of the third embodiment.
Figure 10:
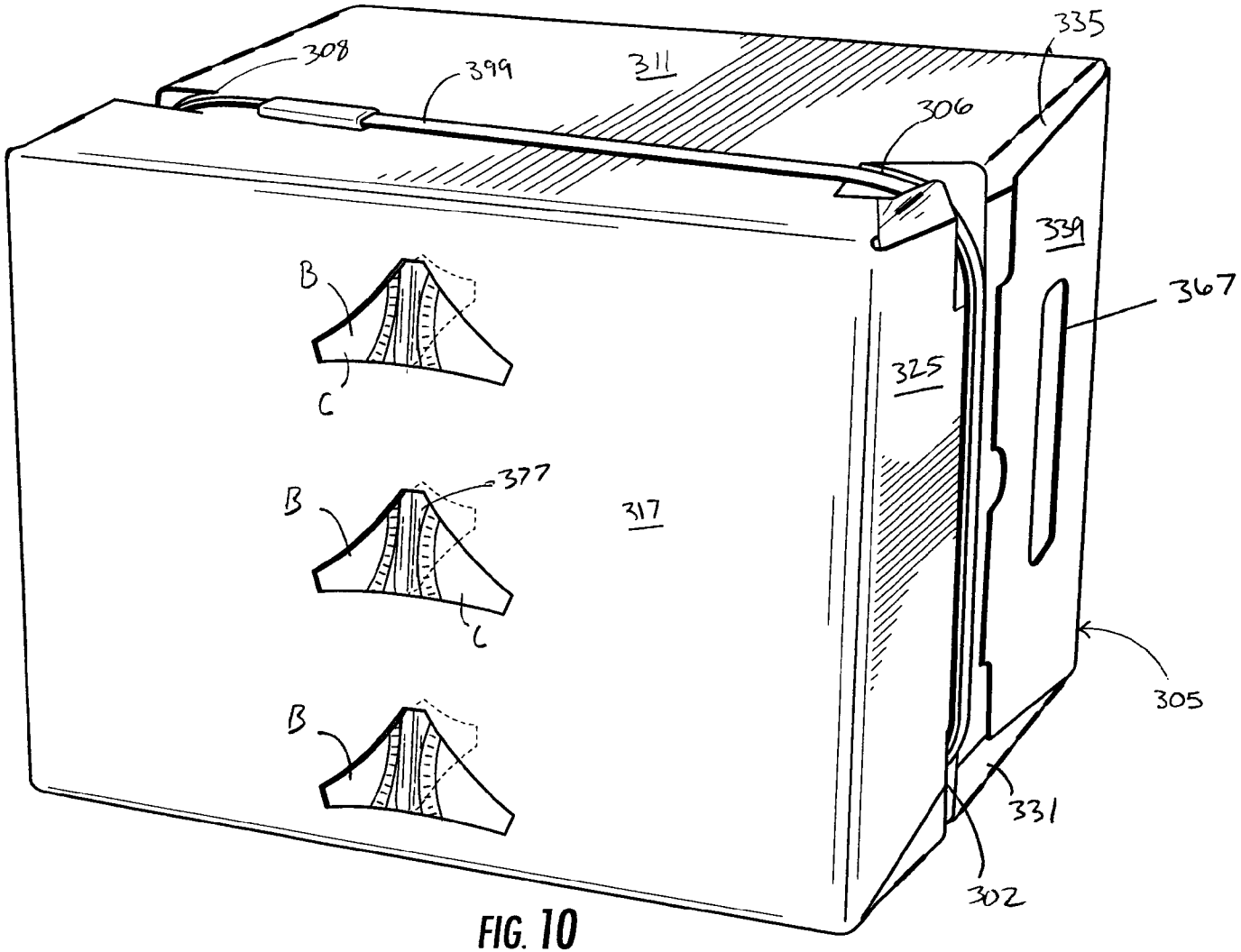

FIGS. 8-10 illustrate various features of a blank 303 for forming a carton 305 of an alternative embodiment having similar features as the first embodiment of the disclosure. Accordingly, similar or identical features of the embodiments are provided with like reference numbers. In the illustrated embodiment, the blank 303 has a top panel 307, bottom panel 317, and respective side panels 309, 311 for forming the sides of the carton 305. The blank 303 has four retention panels 302, 304, 306, 308 that inwardly fold to retain containers stored within when the carton 305 is erected from the blank 303. Further a retention member 399 is tightened circumferentially around the exterior 301 of the carton 305 inwardly pressing the retention panels 302, 304, 306, 308 to secure the containers inside the carton 305.

The blank 303 of FIG. 8 can be formed into the carton 305 in a generally similar manner as described above for the second embodiment. Alternatively, the blank 303 can be formed into a carton 305 by other steps and the blank 303 of the third embodiment could have other features without departing from the disclosure.

In the third embodiment, the top panel 307 is foldably connected to the second side panel 311 at a lateral fold line 315, and foldably connected to an adhesive panel 321 at a lateral fold line 323. The bottom panel 317 foldably connected to a first side panel 309 at a lateral fold line 313 and a second side panel 311 is foldably connected at a lateral fold line 319

The bottom panel 317 is foldably connected to a first bottom end flap 325 and a second bottom end flap 327. The first side panel 309 is foldably connected to a first side end flap 331 and a second side end flap 333. The second side panel 311 is foldably connected to a first side end flap 335 and a second side end flap 337. The top panel 307 is foldably connected to a first top end flap 339 and a second top end flap 341. In one embodiment, when the carton 305 is erected, the end flaps 325, 331, 335, 339, close the first end 351 of the carton, and the end flaps 327, 333, 337, 341 close the second end 353 of the carton. In accordance with an alternative embodiment of the present disclosure, different flap arrangements can be used for closing the ends 351, 353 of the carton 305.

In one embodiment of the disclosure, the blank 303 comprises four retention panels 302, 304, 306, 308. The first article retention panel 302 is foldably connected to the side panel 309 along fold line 312 and foldably connected to the end flap 331 along fold line 314. The second article retention panel 304 is foldably connected to the side panel 309 along fold line 316 and foldably connected to the end flap 333 along fold line 318. The third article retention panel 306 is foldably connected to the side panel 311 along fold line 330 and foldably connected to the end flap 335 along fold line 328. The fourth article retention panel 308 is foldably connected to the side panel 311 along fold line 324 and end flap 337 along fold line 326. The four retention panels 302, 304, 306, 308 each have a first portion 382 foldably connect to the respective side panels 309, 311 along a longitudinal fold lines 312, 316, 330, 324 and a second portion 384 foldably connected to the end flaps 331, 333, 335, 337 along a second longitudinal fold lines 314, 318, 328, 326. The first portion 382 is foldably connected to the second portion 384 along a third longitudinal fold line 320. The edges of the retention panels are formed by cuts 322 that extend from the first fold line 312, 316, 324, 330 to the second fold line 314, 318, 326, 328. The cuts 322 can be other lines of weakness (e.g. openings, slits, tear lines, or any other lines of weakness) without departing from the disclosure. In one embodiment, the third longitudinal fold line is substantially collinear with the respective longitudinal fold line 355, 357 (the ones connecting the end flaps), but the retention panels could be otherwise shaped, arranged, and/or configured without departing from the disclosure.

The blank 303 of FIG. 8 can be formed into the carton 305 in a generally similar manner as described above for the second embodiment. Alternatively, the blank 303 can be formed into carton 305 by other steps and the blank 303 of the third embodiment could have other features.

FIGS. 9-10 show one exemplary erected carton 305 formed from the blank 303 with containers C secured with the retention member 399 tightened around the carton 305 and within lines of weakness 322 of the article retention panels 302, 304, 306, 308. In the illustrated embodiment, the article retention panels 302, 304, 306, 308 are engaged by extending a retaining member 399 around the exterior 301 of the carton 305. The retaining member 399 is positioned between the cuts 322 of the article retention panels 302, 304, 306, 308. Tightening the retaining member 399 positions the article retention panels 302, 304, 306, 308 to contact the articles inside the carton 305. The retaining member 399 can be for example a metal strap, plastic band, rubber band, or a retaining member of any suitable material. The retaining member 399 can otherwise be shaped, arranged, configured, and/or omitted without departing from the disclosure.

The cartons of any of the illustrated or non-illustrated embodiments of the disclosure could have other features (e.g., dispenser features, handle features, reinforcement features, etc.) without departing from the disclosure. Also, the cartons could be otherwise shaped, arranged, or configured and the cartons could be configured to hold articles other than beverage containers without departing from the disclosure.

In general, the blanks of any of the illustrated or non-illustrated embodiments may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type of tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing at least one article, the carton comprising:

a plurality of panels that extends at least partially around the interior of the carton, the plurality of panels comprising a top panel, a bottom panel, a first side panel, and a second side panel;

a plurality of end flaps foldably connected to a respective panel of the plurality of panels, the plurality of end flaps being configured to close an end of the carton, the plurality of end flaps comprises a top end flap; and wherein the top panel comprises a main portion and at least one article retention panel for retaining the at least one article, the main portion is directly foldably connected to at least one of the first side panel and the second side panel along a lateral fold line, the article retention panel is foldably connected to the main portion of the top panel along a first fold line and to the top end flap along a second fold line, the article retention panel is positioned relative to the main portion of the top panel to contact the at least one article.

2. The carton of claim 1, wherein the at least one article retention panel comprises at least one opening for receiving at least a portion of the at least one article.

3. The carton of claim 2, wherein the at least one opening having an edge at least partially formed by a fold line defining at least a portion of a retaining tab, the retaining tab extends in the opening to retain the at least one article.

4. The carton of claim 1, wherein the at least one article retention panel comprises a first article retention panel and a second article retention panel.

5. The carton of claim 4, wherein the top end flap is a first top end flap and the plurality of end flaps comprises a second top end flap, the first article retention panel is foldably connected to the first top end flap and the second article retention panel is foldably connected to the second top end flap.

6. The carton of claim 4, wherein the first article retention panel is foldably connected to the first side panel at a first gusset panel and the second article retention panel is foldably connected to the second side panel at a second gusset panel.

7. The carton of claim 1, wherein the bottom panel comprises at least one article protection flap, the article protection flap is foldably connected to the bottom panel and moveable between a first position that is substantially parallel to the bottom panel and a second position wherein the article protection flap is folded relative to the bottom panel and is positioned for contact with the at least one article.

8. The carton of claim 1, wherein the at least one article retention panel has a first portion foldably connected to a second portion.

9. The carton of claim 8, wherein the first portion is foldably connected to the main portion of the top panel at the first fold line and the second portion is foldably connected to the top end flap at the second fold line.

10. The carton of claim 9, wherein the first portion is foldably connected to the second portion at a third fold line.

11. The carton of claim 8, wherein the at least one article retention panel has edges at least partially formed by lines of weakening at respective ends of the at least one article retention panel.

12. The carton of claim 11 wherein the lines of weakening are cuts, and the cuts extend at least partially into the top panel and the top end flap.

13. The carton of claim 8 wherein the at least one article retention panel comprises a first article retention panel and a second article retention panel, the first article retention panel being at a first end of the carton and the second article retention panel being at a second end of the carton.

14. The carton of claim 10 wherein the first portion is inwardly folded and generally perpendicular to the top panel and the second portion is inwardly folded and generally perpendicular to the top end flap.

15. A blank for forming a carton for containing at least one article, the blank comprising:

a plurality of panels that extends at least partially around an interior of the carton when the carton is formed from the blank, the plurality of panels comprising a top panel, a bottom panel, a first side panel, and a second side panel;

a plurality of end flaps foldably connected to a respective panel of the plurality of panels, the plurality of end flaps being configured to close an end of the carton when the carton is formed from the blank, the plurality of end flaps comprises a top end flap; and wherein the top panel comprises a main portion and at least one article retention panel for retaining the at least one article when the carton is formed from the blank, the main portion is directly foldably connected to at least one of the first side panel and the second side panel along a lateral fold line, the article retention panel is foldably connected to the main portion of the top panel along a first fold line and to the top end flap along a second fold line, the article retention panel is for being positioned relative to the main portion of the top panel to contact the at least one article in the carton formed from the blank.

16. The blank of claim 15, wherein the at least one article retention panel comprises at least one opening for receiving at least a portion of the at least one article in the carton formed from the blank.

17. The blank of claim 16, wherein the at least one opening having an edge at least partially formed by a fold line defining at least a portion of a retaining tab, the retaining tab extends in the opening to retain the at least one article in the carton formed from the blank.

18. The blank of claim 15, wherein the at least one article retention panel comprises a first article retention panel and a second article retention panel.

19. The blank of claim 18, wherein the top end flap is a first top end flap and the plurality of end flaps comprises a second top end flap, the first article retention panel is foldably connected to the first top end flap and the second article retention panel is foldably connected to the second top end flap.

20. The blank of claim 18, wherein the first article retention panel is foldably connected to the first side panel at a first gusset panel and the second article retention panel is foldably connected to the second side panel at a second gusset panel.

21. The blank of claim 15, wherein the bottom panel comprises at least one article protection flap, the article protection flap is foldably connected to the bottom panel and moveable between a first position that is substantially parallel to the bottom panel and a second position wherein the article protection flap is folded relative to the bottom panel and is positioned for contact with the at least one article in the carton formed from the blank.

22. The blank of claim 15, wherein the at least one article retention panel has a first portion foldably connected to a second portion.

23. The blank of claim 22, wherein the first portion is foldably connected to the main portion of the top panel at the first fold line and the second portion is foldably connected to the top end flap at the second fold line.

24. The blank of claim 23, wherein the first portion is foldably connected to the second portion at a third fold line.

25. The blank of claim 22, wherein the at least one article retention panel has edges at least partially formed by lines of weakening at respective ends of the at least one article retention panel.

26. The blank of claim 25 wherein the lines of weakening are cuts, and the cuts extend at least partially into the top panel and the top end flap.

27. The blank of claim 22 wherein the at least one article retention feature comprises a first article retention panel and a second article retention panel, the first article retention panel being at a first end of the carton and the second article retention panel being at a second end of the carton when the carton is formed from the blank.

28. A method of forming a carton, the method comprising:

obtaining a blank comprising a plurality of panels comprising a top panel, a bottom panel, a first side panel, a second side panel, a plurality of end flaps respectively foldably connected to respective panels of the plurality of panels, the plurality of end flaps comprises a top end flap, and wherein the top panel comprises a main portion and at least one article retention panel foldably connected to the main portion of the top panel along a first fold line and to the top end flap along a second fold line, the main portion being directly foldably connected to at least one of the first side panel and the second side panel along a lateral fold line, positioning the plurality of panels to form an interior of the carton, loading at least one article in the interior;

positioning the at least one article retention panel relative to the main portion of the top panel to contact at least one article in the carton after the loading of the at least one article, the positioning comprises moving the article retention panel from a first position that is substantially parallel to the main portion to a second position wherein the article retention panel is folded relative to the main portion.

29. The method of claim 28, wherein loading at least one article comprises loading a plurality of articles.

30. The method of claim 28, wherein the method comprises forming a closed end of the carton by at least partially overlapping the plurality of end flaps with respect to one another.

31. The method of claim 28, wherein the at least one article retention panel comprises at least one opening for receiving at least a portion of the at least one article; and moving the article retention panel to the second position comprises folding the article retention panel relative to the main portion of the top panel and inserting the at least one article through the at least one opening.

32. The method of claim 31, wherein the at least one article retention panel comprises a first article retention panel and a second article retention panel, the first article retention panel is foldably connected to the first side panel at a first gusset panel and the second article retention panel is foldably connected to the second side panel at a second gusset panel.

33. The method of claim 29, wherein the bottom panel comprises a plurality of article protection flaps for providing cushioning, the method comprises positioning the article protection flaps from a first position that is substantially parallel to the bottom panel, to a second position wherein the article protection flaps are folded relative to the bottom panel and each of the plurality of article protection flaps are positioned between two respective adjacent articles of the plurality of articles.

34. The method of 30, wherein the at least one article retention panel has a first portion foldably connected to the main portion of the top panel at the first fold line, a second portion foldably connected to the top end flap at the second fold line, and the first portion is foldably connected to the second portion at a third fold line.

35. The method of 34, wherein the at least one article retention panel comprises a first article retention panel and a second article retention panel, the first and second article retention panel have edges at least partially formed by cuts at respective ends of the first and second article retention panels, and the cuts extend at least partially into the top panel and the top end flap.

36. The method of 34, further comprising inwardly folding the first portion from a first position that is substantially parallel to the top panel to a second position substantially perpendicular to the top panel; and inwardly folding the second portion from a first position that is substantially parallel to the top end flap to a second position substantially perpendicular to the top end flap.

37. The carton of claim 1, wherein the first fold line and the second fold line are generally longitudinal fold lines.

38. The carton of claim 1, wherein the at least one article retention panel is disposed generally perpendicular to at least one of the first side panel and the second side panel.

39. The carton of claim 38, wherein the at least one article retention panel is generally oblique with respect to the main portion of the top panel.

40. The carton of claim 2, wherein the at least one opening is spaced apart from the main portion of the top panel.

41. The blank of claim 15, wherein the first fold line and the second fold line are generally longitudinal fold lines.

42. The blank of claim 15, wherein the at least one article retention panel is for being disposed generally perpendicular to at least one of the first side panel and the second side panel when the carton is formed from the blank.

43. The blank of claim 42, wherein the at least one article retention panel is for being generally oblique with respect to the main portion of the top panel when the carton is formed from the blank.

44. The blank of claim 16, wherein the at least one opening is spaced apart from the main portion of the top panel.

45. A carton for containing at least one article, the carton comprising:

a plurality of panels that extends at least partially around the interior of the carton, the plurality of panels comprising a top panel, a bottom panel, a first side panel, and a second side panel;

a plurality of end flaps foldably connected to a respective panel of the plurality of panels, the plurality of end flaps being configured to close an end of the carton, the plurality of end flaps comprises a top end flap; and wherein the top panel comprises a main portion and at least one article retention panel for retaining the at least one article, the article retention panel is foldably connected to the main portion of the top panel and to the top end flap, the article retention panel is positioned relative to the main portion of the top panel to contact the at least one article, wherein the at least one article retention panel is foldably connected to at least one of the first side panel and the second side panel by at least one gusset panel, and the main portion of the top panel is foldably connected to the at least one of the first side panel and the second side panel along a lateral fold line;

wherein the at least one gusset panel is at least partially in face-to-face contact with the at least one of the first side panel and the second side panel.

46. A blank for forming a carton for containing at least one article, the blank comprising:

a plurality of panels that extends at least partially around an interior of the carton when the carton is formed from the blank, the plurality of panels comprising a top panel, a bottom panel, a first side panel, and a second side panel;

a plurality of end flaps foldably connected to a respective panel of the plurality of panels, the plurality of end flaps being configured to close an end of the carton when carton is formed from the blank, the plurality of end flaps comprises a top end flap; and wherein the top panel comprises a main portion and at least one article retention panel for retaining the at least one article when the carton is formed from the blank, the article retention panel is foldably connected to the main portion of the top panel and to the top end flap, the article retention panel is for being positioned relative to the main portion of the top panel to contact the at least one article in the carton formed from the blank, wherein the at least one article retention panel is foldably connected to at least one of the first side panel and the second side panel by at least one gusset panel, and the main portion of the top panel is directly foldably connected to the at least one of the first side panel and the second side panel along a lateral fold line.

47. The blank of claim 46, wherein the at least one gusset panel is foldably connected to the at least one article retention panel along the lateral fold line, and the at least one gusset panel is foldably connected to the at least one of the first side panel and the second side panel along at least one oblique fold line.

48. The blank of claim 46, wherein the at least one gusset panel comprises a first gusset panel foldably connected to the at least one article retention panel and the first side panel and a second gusset panel foldably connected to the at least one article retention panel and the second side panel.

49. The blank of claim 46, wherein the at least one article retention panel comprises a first article retention panel and a second article retention panel, the at least one gusset panel comprises a first gusset panel and a second gusset panel, the first article retention panel is foldably connected to the first side panel by the first gusset panel, and the second article retention panel is foldably connected to the first side panel by the second gusset panel.

50. The carton of claim 45, wherein the at least one gusset panel comprises a first gusset panel foldably connected to the at least one article retention panel and the first side panel and a second gusset panel foldably connected to the at least one article retention panel and the second side panel.

51. The carton of claim 45, wherein the at least one article retention panel comprises a first article retention panel and a second article retention panel, the at least one gusset panel comprises a first gusset panel and a second gusset panel, the first article retention panel is foldably connected to the first side panel by the first gusset panel, and the second article retention panel is foldably connected to the first side panel by the second gusset panel.

* * * * *